United States Patent [19]

Chen

[11] Patent Number: 4,972,308

[45] Date of Patent: Nov. 20, 1990

[54] INNOVATED LAMP FITTING SET WITHOUT WELDING

[76] Inventor: I-Ming Chen, No. 27, Wulin St., Shulin, Taipei Hsien, Taiwan

[21] Appl. No.: 464,549

[22] Filed: Jan. 16, 1990

[51] Int. Cl.[5] ..... F21V 5/00; F21V 17/00

[52] U.S. Cl. ..... 362/367; 362/330

[58] Field of Search ..... 362/363, 367, 330, 410

[56] References Cited

U.S. PATENT DOCUMENTS

| | | | |
|---|---|---|---|
| 1,575,245 | 3/1926 | Wurdack, Jr. | 362/363 |
| 1,791,674 | 2/1931 | King | 362/367 |
| 3,365,571 | 1/1968 | Kozil | 362/367 |
| 3,590,237 | 6/1971 | Winters et al. | 362/367 |
| 3,896,226 | 7/1975 | Murray et al. | 362/367 |

FOREIGN PATENT DOCUMENTS

| | | | |
|---|---|---|---|
| 11094 | of 1904 | United Kingdom | 362/363 |

*Primary Examiner*—Stephen F. Husar
*Assistant Examiner*—Peggy Neils
*Attorney, Agent, or Firm*—Notaro & Michalos

[57] ABSTRACT

A lamp set which is assembled without welding comprises a lamp seat for receiving a lamp bulb and a lower fixing frame connected to the lamp seat. An upper frame, a second lower frame and a cover frame are also included with all frames having a plurality of holes spaced therearound. A plurality of glass clamps equal in number to the plurality of holes in the lower fixing frame include two troughs on opposite sides thereof and two screws on opposite ends thereof. Screws at the lower ends of the clamps are inserted into respective holes of the lower fixing frame. A plurality of glass panels have side edges which extend into the troughs of the glass clamps so that the clamps and the panels are distributed around the lower fixing frame. The upper fixing frame with the plurality of holes is engaged onto the upper screws of the clamps. A U-shaped connecting frame having a lower set of holes is also fitted onto the upper screws of the clamps. A similarly constructed upper half of the lamp set includes a second lower fixing frame and a cover frame having clamps with troughs and screws thereon and including glass panels with side edges engaged in the trough. Ball nuts are threaded onto the screws for holding the lamp set together without welding.

3 Claims, 3 Drawing Sheets

INNOVATED LAMP FITTING SET WITHOUT WELDING

FIELD AND BACKGROUND OF THE INVENTION

The present invention relates in general to lamps, and in particular to a lamp fitting set featuring convenient assembly and disassembly, easy maintenance, and an unrestricted size.

The lamp set of the invention comprises a clamp body, glass clamps, screws, ball nuts, a connecting frame, glass panels and an upper cover. Each glass clamp is formed of a member with opposite troughs for side edges of a glass panel and upper and lower screws for connecting fixing frames at upper and lower edges of the glass panel. Several glass clamps and glass panels are dovetailed as required, and the dovetailed glass clamps and glass panels are fixed into one body by the fixing frames which have a number of holes equal to the number of glass clamps and screws. Ball nuts at the upper and lower halves of the lamp body engage the screws after they are passed through the holes for connecting the frames to the clamps. Upper and lower halves of the lamp body are combined into one with additional ball nuts, to become a practical creation with easy access for maintenance, simple assembly and disassembly, sturdy and safe construction and reduced cost.

Known lamp fitting sets which are made by a conventional welding method, are favored by Westerners because of their variety in styling for indoor or outdoor use. Because the lamp bodies of such lamp sets are manually welded, their production is slow and with limited capacity. This results in extended delivery schedules and increased labor costs. Also, because of insufficient labor sources, prices on such products could no longer compete with those made in areas having cheap labor. Furthermore, during welding, when the glass is damaged due to accidental impact, the lamp body falls apart easily and may cause serious accidental damage.

For these reasons, the inventor hereof has actively studied to find a solution to such problems, and has finally designed and developed a type of lamp fitting set which is assembled without welding but which retains the features of lamp sets that use welding. The lamp set of the invention is not limited in size and can be made in large sizes and weights. Glass panels are easily replaced if damaged, and manual production costs is reduced. The lamp of the invention can be made in various types and models and will therefore be able to attract consumers. Consumer standards will also be increased, leading to a fashion tread and upgraded domestic lamp set design standards. In conventional welded models, the following defects can easily be found in manufacturing process, maintenance, packaging, or 1. A welded lamp body is of fragile construction, is unable to withstand large weight and therefore, its size is restricted. Welded areas also are also darker due to oxidation.

2. The welded lamp body is restricted in weight, lamp size variations, and is not suitable for all locations.

3. The joining process using welding must be conducted by skilled workers, so that production is slow and labor costs are high. The process is also open to industrial hazard, so that operators are difficult to find.

4. The welded lamps also have inconsistent exterior appearance and uncontrollable quality. Defective parts cannot be replaced, resulting in increased cost and quality which is not uniform.

5. Welding is also an integrated forming process where the lamp can not be disassembled. This results in large packaging measurements with higher freight cost.

6. Any glass damage during the handling process also means that the whole set is unusable. In view of the above defects, the subject invention has been developed and has the following features:

1. The invention uses a screw fixing method which is sturdy and safe. The size of the lamp body is not restricted. No oxidation darkness occurs.

2. Variable styling is possible with multilayered and curves appearances. This retains the beautiful configuration of conventionally welded lamp fittings, so that various models can be made to suit various locations.

3. The invention requires reduced production time and has no need for skilled operators. Prompt production is thus possible at significantly reduced labor costs.

4. Assembly is also easy, quality is controllable and defective parts can be replaced.

5. The invention can also be disassembled for packaging, thus reducing freight measurements and cost.

SUMMARY OF THE INVENTION

This invention relates to a type of lamp fitting set which is assembled without welding and which comprises a lamp seat, glass clamps, ball nuts, connecting frames, glass panels and an upper cover. The parts are joined by screws to facilitate easy assembly and disassembly. Lamp size is not restricted. Each of the glass clamps have opposite troughs at opposite sides thereof, and opposite screws at opposite ends thereof. Several glass clamps with glass panels therebetween are fixed around a fixing frame which has a number of holes equal to the number of screws, so that the glass panels can be inserted into place and fixed by the ball nuts. Upper and lower halves of the lamp body are connected with screws on one end of glass clamps penetrating the holes of a frame near the middle of the lamp. The invention is easy to assemble and disassemble, has easy maintenance and reduced cost.

BRIEF DESCRIPTION OF THE DRAWINGS

FIG. 1—1 is a sectional view of a glass clamp and glass panels engaged thereto;

DESCRIPTION OF THE PREFERRED EMBODIMENT

For a better understanding of the features and function of the subject invention, reference is made to drawings.

Figure 1:
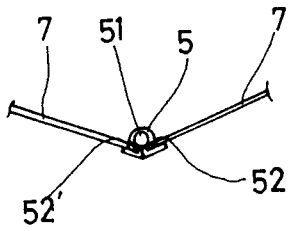
FIG. 1 is an exploded perspective view of the invention.
Figure 1:
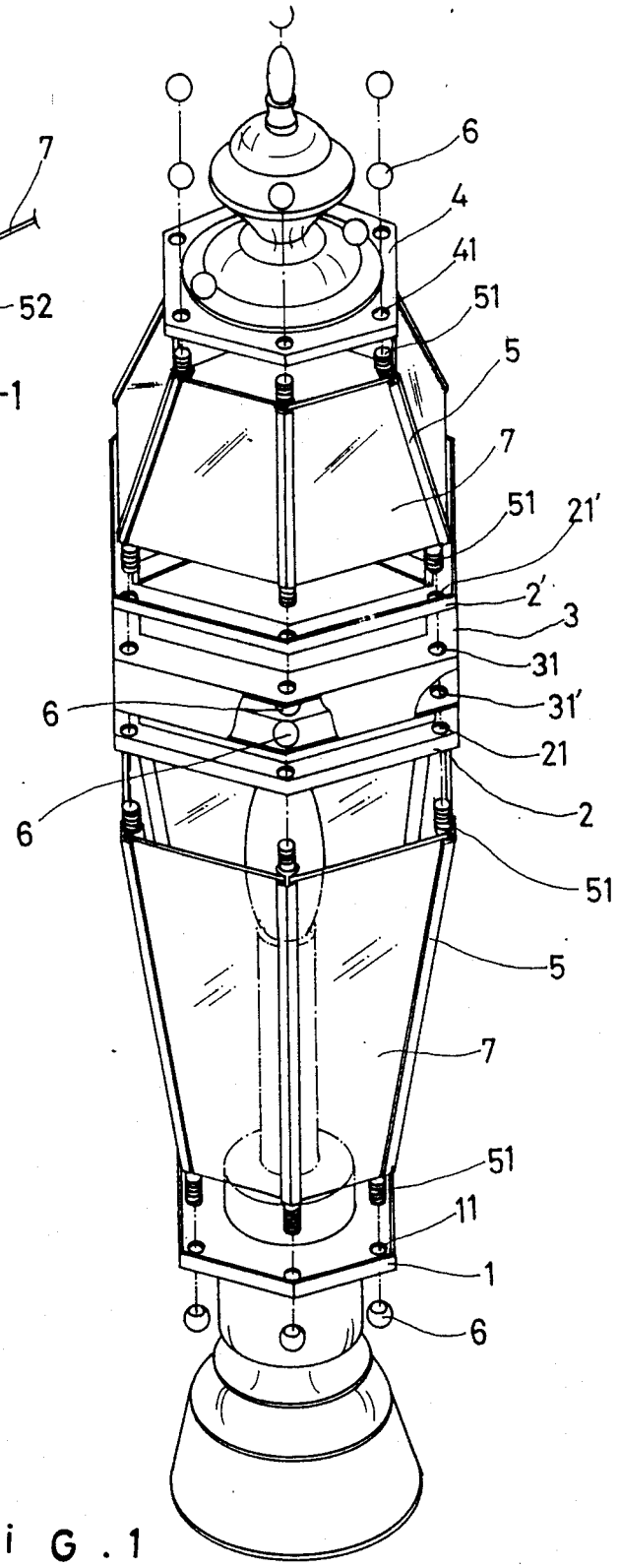
Figure 2:
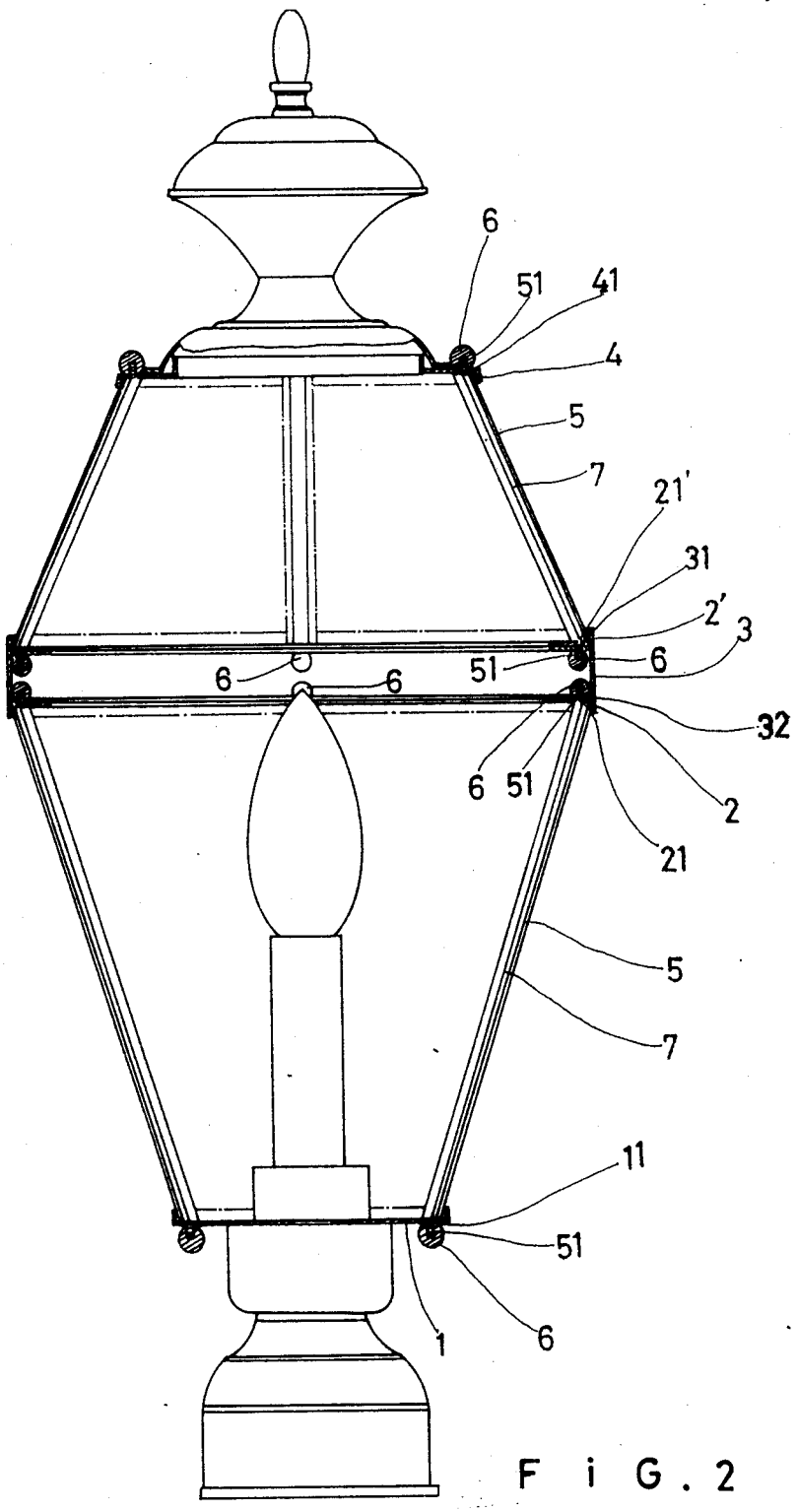
FIG. 2 is a vertical sectional view of the invention, party in elevation.

FIGS. 1, 1—1 and 2 are views of the invention.

In the drawings, two sides of glass clamps 5 are visible, each with troughs 52, 52' on opposite sides thereof for receiving side edges of glass panels 7. Each clamp 5 has a pair of screws 51 on opposite ends thereof. Several glass panels 7 and glass clamps 5 are mounted by means of holes 11, 21, 21' and 41, on fixing frames 1, 2, 2, and 4, with the screws 51 on each glass clamp 5 extending into one of the holes. In this way the clamps 5 and glass panels 7 are combined and fixed by ball nuts 6 to the frames. To connect upper and lower halves of the lamp body a connecting frame 3 with holes 31, 31' is used. The screws 51 on one end of glass clamps 5, penetrate the holes 31 and 31' and are fixed into one body by inner ball nuts 6.

FIG. 1 also shows a lamp seat extending upwardly from frame 1 for receiving a lamp bulb. The lower fixing frame 1 is connected to the lamp seat and has the plurality of holes 11 spaced therearound.

The upper fixing frame 21 connected to the clamps 5 and panels 7 by screws 51 and ball nuts 6 form a lower half of the lamp body.

An upper half of the lamp body is formed by the second lower fixing frame 2', the second plurality of clamps 5 and glass panels 7, and frame 4 which forms a cover frame for the lamp. Frames 2' and 4 are connected to clamps 5 and glass panels 7 by screws 51 and ball nuts 6.

The connecting frame 3 has a U-shaped cross section with upper and lower pluralities of holes 31 and 31' that receive upper screws 51 of the lower lamp body half and lower screws 51 of the upper lamp body half.

As shown in FIGS. 1 and 2, the lamp set has a central axis extending through the upper and lower fixing frames and through the second lower fixing frame and the cover frame. The plurality of clamps and glass panels in the lower body half of the lamp extend at a non-zero angle with respect to the central axis while the screws extend substantially parallel to the central axis.

Figure 3:
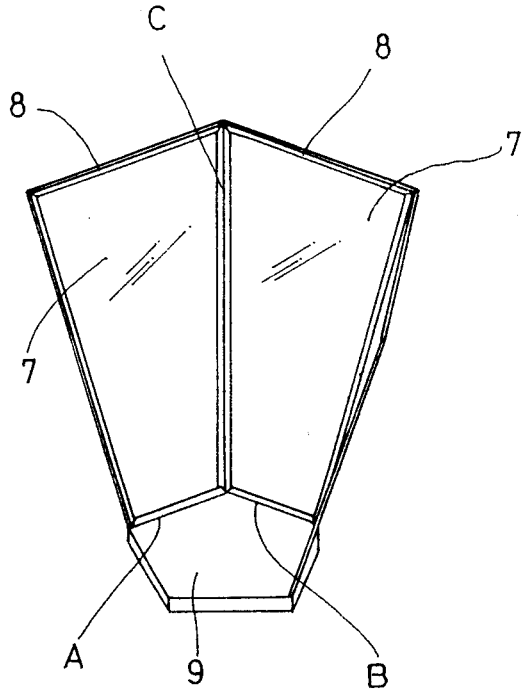
FIG. 3 is a perspective view of a conventional welded lamp set.

FIG. 3 is a view of a conventional welded lamp set, in which the glass panels 7 are first inserted into frame 8, then the frame 8 is welded to formed plate 9 at spots A, B and C.

What is claimed:

1. A lamp set which is assembled without welding, comprising:

a lamp seat for receiving a lamp bulb;

a lower fixing frame connected to the lamp seat and having a plurality of holes therethrough space therearound;

a plurality of glass clamps equal in number to the plurality of holes in said lower fixing frame, each glass clamp having two troughs on opposite sides thereof and two screws at opposite ends thereof, the screw at the lower end of each clamp being inserted into one of said holes in said lower fixing frame;

a plurality of glass panels, each glass panel having opposite edges extending into the troughs of adjacent glass clamps, each glass panel being supported on the lower fixing frame;

an upper fixing frame having a plurality of holes therethrough equal in number to the plurality of holes through said lower fixing frame, the screw extending from an upper end of each glass clamp extending into one of the holes in said upper fixing frame;

a plurality of ball nuts threaded onto said screws for holding said upper and lower fixing frames to said clamps and for retaining said glass panels between said upper and lower fixing frames and between said clamps;

a second lower fixing frame having a plurality of holes therethrough spaced therearound;

a second plurality of glass clamps equal in number to said holes through said second lower fixing frame, each second clamp having two troughs on opposite sides thereof and two screws at opposite ends thereof, screws at the lower ends of said second clamps extending through respective holes through said second lower fixing frame;

a second plurality of glass panels each engaged into troughs of adjacent second clamps, each second glass panel being supported on the second lower fixing frame;

a cover frame having a plurality of holes therethrough, the screws in the upper ends of said second clamps extending respectively through the holes of said cover frame;

a second plurality of ball nuts threaded onto the screws of said second plurality of clamps for connecting said second lower fixing frame and said cover frame to said second plurality of clamps; and a connecting frame having a U-shaped cross section, said connecting frame having upper and lower flanges with pluralities of holes therethrough with a lower flange of said connecting frame having a number of holes equal to the number of holes through said upper fixing frame and an upper flange of said connecting frame having a number of holes equal to the number of holes in said second lower fixing frame, the screws at the upper ends of said first mentioned plurality of clamps extending through the holes in the lower flange of said connecting frame and the screws of the lower ends of the second plurality of clamps extending through the holes in the upper flange of said connecting frame.

2. A lamp set according to claim 1 wherein said lamp seat has a central axis, each of said glass clamps extending at a non-zero angle to said central axis and each of said screws extending substantially parallel to said central axis.

3. A lamp set according to claim 1 including a central axis extending through said upper and lower fixing frames and through said second lower fixing frame and said cover frame, said first mentioned plurality of clamps extending at a non-zero angle to said central axis and said second plurality of clamps extending at a non-zero angle to said central axis, said screws of said first mentioned and said second plurality of clamps extending substantially parallel to said central axis.

* * * * *